US005415456A

United States Patent [19]

Hart et al.

[11] Patent Number: 5,415,456

[45] Date of Patent: May 16, 1995

[54] COLLAPSIBLE BABY CHAIR APPARATUS

[75] Inventors: Peter Hart, Saline; David L. Gerrard, Edinburgh, both of Scotland

[73] Assignee: Sassy, Inc., Northbrook, Ill.

[21] Appl. No.: 4,714

[22] Filed: Jan. 14, 1993

[30] Foreign Application Priority Data

Apr. 9, 1992 [GB] United Kingdom ..... 2025475

[51] Int. Cl.[6] ..... A47C 4/00

[52] U.S. Cl. ..... 297/174; 297/135

[58] Field of Search ..... 297/174, 135, 378.1, 297/378.12, 17, 16.1, 183

[56] References Cited

U.S. PATENT DOCUMENTS

| | | | |
|---|---|---|---|
| 3,222,104 | 12/1965 | Remington et al. | 297/174 X |
| 4,506,928 | 3/1985 | Marion | 297/174 |
| 4,568,120 | 2/1986 | Hoffman | 297/174 |
| 4,586,746 | 5/1986 | Day et al. | 297/174 |
| 4,629,247 | 12/1986 | Wu | 297/174 |
| 4,818,016 | 4/1989 | Mariol et al. | 297/174 |

FOREIGN PATENT DOCUMENTS

| | | | |
|---|---|---|---|
| 0272794 | 1/1951 | Switzerland | 297/174 |

*Primary Examiner*—Kenneth J. Dorner

*Assistant Examiner*—Milton Nelson, Jr.

*Attorney, Agent, or Firm*—Dick & Harris

[57] ABSTRACT

A collapsible baby chair apparatus for attachment to an elevated member having a top and bottom surface, such as a tabletop or projecting countertop. The apparatus includes a chair member having a seat portion and a back portion, and a pair of frame members which are operably, pivotally attached to each other in a scissors-like orientation. The seat and back portions may be secured in an opened, seating, position and then releasably foldable to a closed position of reduced profile upon release of a biased locking mechanism. The two frame members each include at least two free ends which are pivotally spread apart and/or closed toward each other by manipulation of the frame members in a scissors-like manner—so as to facilitate positioning of the respective free ends adjacent the top and bottom surfaces of the elevated member. Frame members and securement members enable the chair to be clamped into secured attachment to the elevated member and/or to maintain the chair in its collapsed orientation prior to or after use of the apparatus. When the frame members are completely collapsed and the chair is in its closed position, the apparatus assumes a substantially thin orientation for portability.

14 Claims, 3 Drawing Sheets

85
28
20
56
36
55
24
26
30
86
57
62
35
58
32
61

20
32

22
64
55
57
59'
86
60
87
62
85
67
58
88
35
56
59
61
30
26
66

20
22
32
41
48
43
70
28
34
72
57
30
62
56
38
47
45
49
24
46
50

20
57
90a
55
90b
90
62
56
75
82
40
34
28
77
41
78
24

48
53
46
50

47
45
49
52

COLLAPSIBLE BABY CHAIR APPARATUS

BACKGROUND OF THE INVENTION

The present invention relates in general to baby chairs, and in particular, to a collapsible baby chair apparatus for releasably secured attachment to an elevated member or surface, such as a table or countertop.

Baby chairs used for attachment to elevated surfaces have been known in the art for several years. Typically, such prior art baby chairs have been constructed with two substantially parallel frame members, an intermediary linkage between the two frame members, and a chair portion, wherein one of the frame members (typically the bottom frame member) either pivots or is restrained relative to the intermediary vertical linkage—so as to enable the free ends of the frame members to be moved apart, or closer to each other, toward respective attachment and removal of the baby chair to the surface to which it is attached. In this prior art, the top frame member is often rigidly and nonpivotally supported adjacent the chair portion of the device by substantially vertical support bars comprising the intermediary linkage. Accordingly, while the top frame member is often precluded from movement, the bottom frame member can pivot so as to provide a clamping effect with respect to the free ends of the frame members prior to and after attachment of the device to the elevated surface. Once the free ends of the frame members are clamped about the elevated surface, release of the pivoting frame member, and, in turn, release of the baby chair from the elevated surface, is substantially precluded by way of a releasably locking ratchet mechanism associated with at least the pivoting frame member. Examples of such prior art devices include: Hoffman, U.S. Pat. No. 4,568,120; and Mariol, U.S. Pat. No. 4,818,016, which prior art shows alternative pivotal and/or fixed intermediary linkages respectively.

Although such baby chairs have been effective with respect to their relatively secured and releasable attachment to an elevated surface, they have not contemplated the consumers' desire for improved collapsibility, and, in turn, compactability of such an apparatus for storage and shipping purposes when the apparatus is not in use. Indeed, inasmuch as such prior art baby chairs generally include substantially vertical support members for maintaining at least one of the frame members in a substantially rigid, non-pivotal orientation during and after usage of the chair itself, such baby chairs have been incapable of collapsing both of the frame members into a compact, relatively thin transverse profile after removal from the elevated surface to which the device was attached. Even where such prior art chairs have collapsible intermediary linkages, compactability is affected together with increased production weight and shipping costs.

Accordingly, few, if any of the prior art baby chairs for use in attachment to an elevated surface eliminate the use of vertical supporting bars so as to facilitate collapsibility and/or compactability of both of the frame members after the apparatus is removed from the surface to which it was attached. Furthermore, although some of such prior art does disclose partial collapsibility with respect to the back portion of the chair section, few, if any of such prior art teaches, much less discloses, complete collapsibility of both the seat and back portions from a fully erected opened and releasably locked orientation to a substantially closed, or collapsed, orientation—so as to provide a fully collapsible baby chair apparatus having a substantially thin transverse profile when the apparatus has been manipulated into its collapsed orientation. Such a construction, in turn, facilitates storing and/or shipping of the apparatus prior to and/or after it has been attached and then removed from the elevated surface.

It is thus an object of the present invention to provide a collapsible baby chair apparatus which includes two frame members pivotally attached to each other in a scissors-like orientation, and without the use of substantially vertical support members, so as to facilitate collapsibility of both of the frame members when the apparatus is not in use.

It is also an object of the present invention to provide a collapsible baby chair apparatus which includes a back and seat portion which are both secured in an open position during use, and then releasable to a substantially folded, or closed, position when the apparatus is not in use, so as to further reduce the transverse profile of the collapsible baby chair apparatus prior to and after use.

It is still further an object of the present invention to provide a collapsible baby chair apparatus which can be easily carried after it has been collapsed, and which can be stored and/or shipped without taking up an excessive amount of space.

It is also an object of the present invention to provide a collapsible baby chair apparatus which safely maintains the frame members and the chair portion in an open, fully erected orientation, while further facilitating release of the apparatus from the fully erected orientation towards collapsibility of same when the apparatus is to be removed from the elevated surface to which it is attached.

These and other objects of the present invention will become apparent in light of the present specification, claims and drawings.

SUMMARY OF THE INVENTION

The present invention comprises a collapsible baby chair apparatus for attachment to an elevated member having a top and bottom surface, such as a table top or countertop. The apparatus is collapsible from a fully erected attached orientation to a collapsed orientation wherein the apparatus evokes a relatively thin transverse profile. The apparatus includes chair means having a seat portion, which includes a front peripheral edge, and a back portion pivotally attached to the seat portion, so as to provide a bottom and back support, respectively, for a child when the child is sitting in the collapsible baby chair apparatus. The chair means additionally includes pivoting means between the seat and back portions for operably positioning both of the seat and back portions from a substantially closed position when the collapsible baby chair apparatus is in its closed orientation, toward and into a substantially opened position when the apparatus is its fully erected attachment orientation.

Locking means are operably associated with at least one of the seat and back portions for releasably securing the seat and back portions in the substantially open position. A pair of chair attachment means are pivotally attached to each other in a scissors-like orientation for operably attaching the baby chair apparatus to an elevated member. The pair of attachment means include a first frame member and a second frame member, wherein at least one of the first and second frame members is operably attached to a portion of the chair means. The first frame member has at least two free ends positioned in substantially parallel and planar relationship with each other for underlying the bottom surface of the elevated member, and the second frame member has at least two free ends positioned in substantially parallel and planar relationship with each other for overlying the top surface of the elevated member.

The free ends of the first frame member are in substantially adjacent relationship with respect to the free ends of the second frame member and are capable of being retracted from the free ends of the second frame member toward attachment about the elevated member. In addition, such free ends are also capable of being advanced toward one another for operable clamped attachment about the elevated member. The closing of the two or more free ends of the first member toward the free ends of the second member further serve to reduce the transverse profile of the collapsible baby chair apparatus upon collapsing of same. It is contemplated that all of the free ends include grasping means operably attached thereto for reducing the likelihood of slippage of the apparatus when it is attached to the elevated members. The grasping means may be constructed of rubber, polyurethane, or any other material having a relatively high co-efficient of friction.

Securing means are operably attached to a portion of at least one of the first and second frame members for releasably maintaining the two or more free ends of the first and second frame members, respectively, clamped and relatively biased towards each other, after the first and second frame members, and, in turn, the collapsible baby chair apparatus has been operably attached about the elevated member. Furthermore, it is also contemplated that the free ends of the frame members extend beyond the front peripheral edge of the seat portion when the apparatus is attached to the elevated member.

In the preferred embodiment of the invention, the securement means further includes disengagement means for releasing the two or more free ends of the first and second frame members from their respective biased positions relative to each other. In this preferred embodiment, the securement means comprises one or more ratchet mechanisms operably attached to the first and second frame members. The one or more ratchet mechanisms include a rack having a plurality of teeth operably attached to one of the first and second frame members and a pawl operably attached to the other of the first and second frame members.

The disengagement means further includes release preclusion means for restricting inadvertent release of the securement means. The release preclusion means comprises a biased button operably associated with the pawl. The pawl is precluded from release from the teeth of the rack until the biased button is independently held in a depressed position.

In a preferred embodiment of the invention, the locking means for releasably securing the seat and back portions in the substantially open position is spring biased so as to be self-actuating upon manual manipulation of at least one of the seat and back portions of the chair means to the open position. Each of the seat and back portions are replaceable to their respective collapsed closed positions upon overcoming the bias of the locking means to disengage same.

In this preferred embodiment, the back portion of the chair means includes a bottom region having a back lip member, and the seat portion includes a rear end region having a seat lip member. Each of the locking means include a bias lever having a distal end, having one or more hook members and a proximal lever end, wherein the one or more hook members of the distal end are operably engageable with the respective one of the back and seat lip members of the back and seat portions, respectively, so as to maintain each of the seat and back portions releasably restrained in their open secured position. The hook portions of the locking means are releasable from the respective back and seat lip members upon manual depression of the proximal lever ends, to, in turn, facilitate collapsibility of the back and seat portions respectively toward orientation into their closed position. In this embodiment, the locking means for the seat portion, and the locking means for the back portion are interconnected with each other so as to pivot about a common pivot access.

In the preferred embodiment of the invention, the apparatus further includes handle means which are operably attached to at least one of the first and second frame members for facilitating carrying of the collapsible baby chair apparatus when it is in its-closed collapsed orientation. Furthermore, restraint means which may comprise one or more straps, are used for securing a child within the chair when it is in its open position.

DETAILED DESCRIPTION OF THE DRAWINGS

Figure 1:
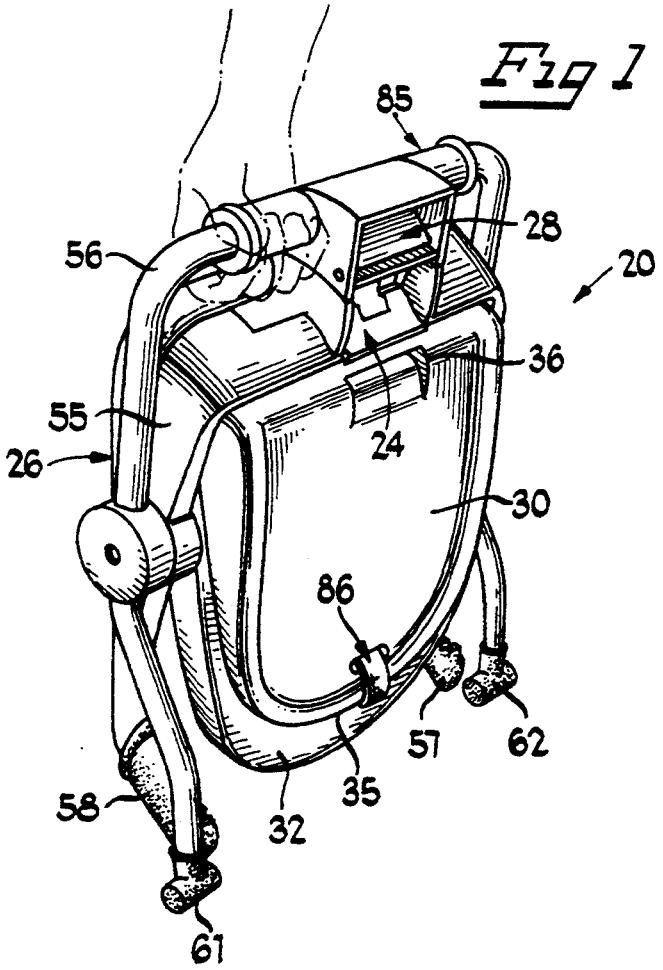
FIG. 1 of the drawings is a perspective view of the collapsible baby chair apparatus in its collapsed orientation, showing, in particular, the substantially thin transverse profile of the first and second frame members, as well as the seat and back portions of the chair means in their closed positions.

While this invention is susceptible of embodiment in many different forms, there is shown in the drawings and will herein be described in detail, one specific embodiment with the understanding that the present disclosure is to be considered as an exemplification of the principles of the invention and is not intended to limit the invention to the embodiment illustrated.

Figure 2:
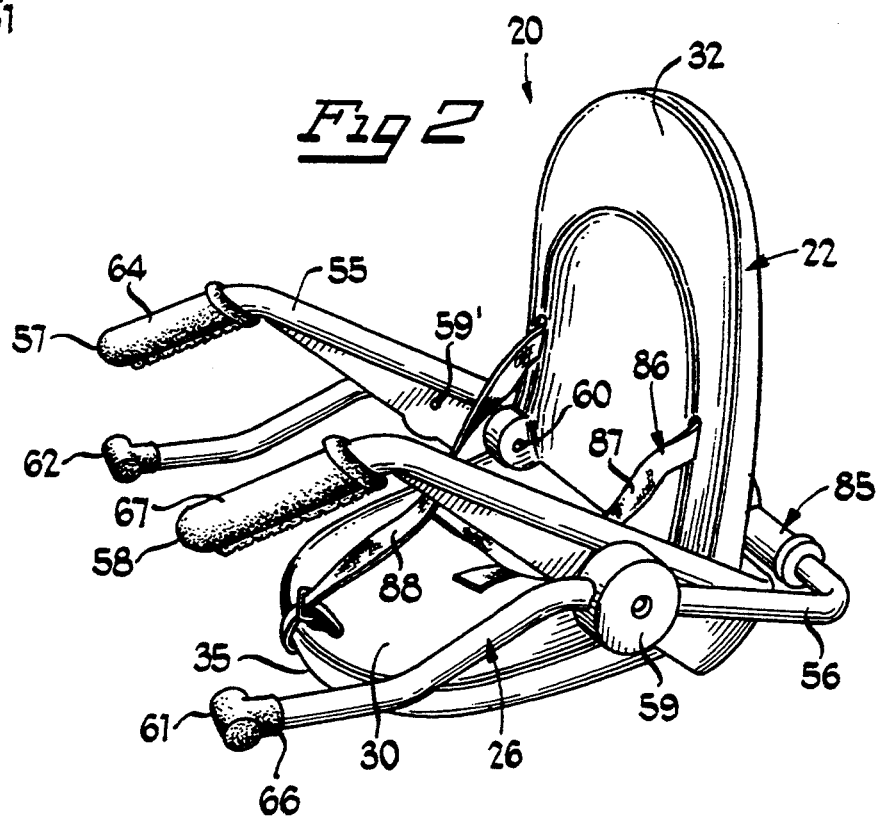
FIG. 2 of the drawings is an elevated perspective view of the collapsible baby chair apparatus shown in its fully erected orientation showing, in particular, the scissors-like attachment between the first and second frame members, the pivotal attachment of the second, upper frame member to the chair means, the grasping means on the free ends of the first and second frame members, as well as the open, locked position of the seat portion relative to the back portion of the chair means.
Figure 3:
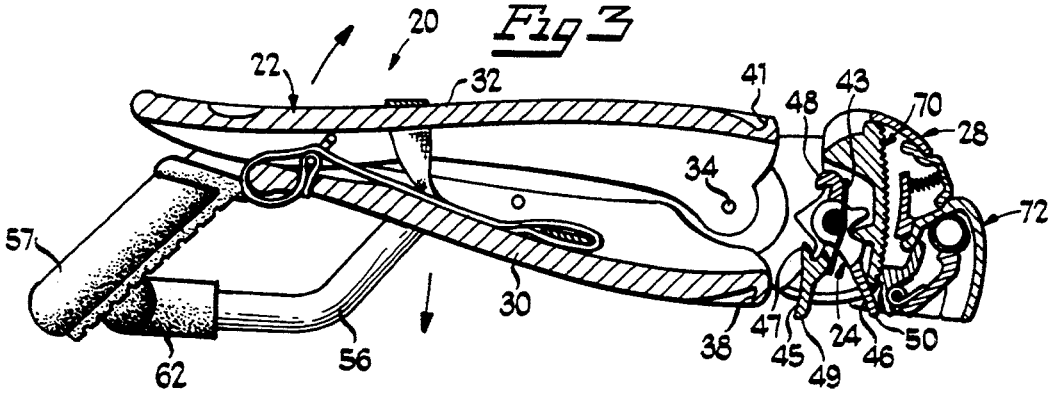
FIG. 3 of the drawings is an elevated cross-sectional side view of the collapsible baby chair apparatus in its collapsed orientation, showing, in particular, the positioning of the pawl near the lower region of the rack of the ratchet mechanism, the outwardly biased positioning of the biased button, the biased levers used for securing the seat and back portions of the chair means in an open position, as well as the lip members of the seat and back portions which are operably engaged by the hooked distal ends of the biased levers upon reorientation to their open, erected positions.
Figure 4:
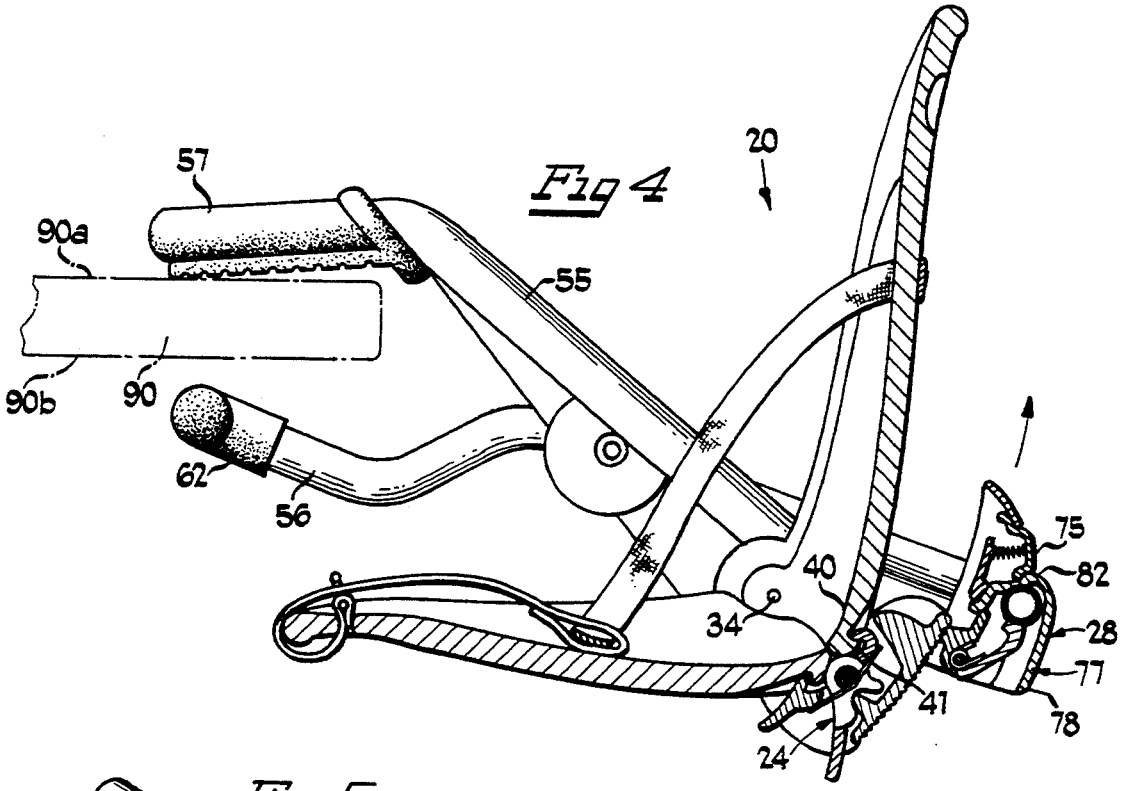
FIG. 4 of the drawings is an elevated cross-sectional side view of the collapsible baby chair apparatus showing, in particular, the engagement of the hooks of the biased levers of the locking means to the lip members of the seat and back portions of the chair means for securing same in an open position, the rack and pawl of the ratchet mechanism used for maintaining the first and second frame members in a secured, clamped arrangement, and the biasing means used for precluding inadvertent release of the pawl.

Collapsible baby chair apparatus 20 is shown in FIG. 1 and FIG. 2 as comprising chair means 22 locking means 24 (FIG. 1), chair attachment means 26 and securement means 28 (FIG. 1). Chair means 22 includes seat portion 30, back portion 32 and pivoting means 34, as shown in FIG. 3 and FIG. 4. Seat portion 30 has front peripheral edge 35 and rear end region 36 (FIG. 1) which includes lip member 38. Back portion 32 includes bottom region 40 (FIG. 4) which also includes lip member 41. As will be explained, lip members 38 and 41 cooperate with locking means 24 to maintain chair means 22 in an open position, as shown in FIG. 2 and FIG. 4.

Locking means 24 are shown in detail in FIG. 3 and FIG. 8 through FIG. 10, as including biasing means 43 and a pair of interconnected, pivotally attached biased levers 45 and 46. Biased levers 45 and 46 each include a distal end 47 and 48, respectively, and a proximal lever end 49 and 50, respectively. Distal ends 47 and 48 each include a hook 52 and 53 (FIG. 8), respectively, for use in engageable cooperation with lip members 38 and 41 (FIG. 3 and FIG. 10), respectively, of seat portion 30 and back portion 32 of chair means 22 (FIG. 3).

Chair attachment means 26 are shown in FIGS. 1 and 2 as including first lower frame member 56 and second upper frame member 55. First frame member 56 is pivotally attached to second frame member 55 in a scissors-like orientation at pivot point 59 and 59' (FIG. 2), while second frame member 55 is further pivotally attached to chair means 22 at pivot attachment region 60 (FIG. 2). Second upper frame member 55 includes free ends 57 and 58 and first lower frame member 56 includes free ends 61 and 62. Each of these free ends are operably associated with grasping means 64 through 67 (FIG. 2) which are constructed from a material having a relatively high co-efficient of friction, such as rubber or polyurethane, so as to preclude the likelihood of slippage of the apparatus when it is attached to a table and when a child is seated therein.

Also shown in FIGS. 1 and 2 are handle means 85 and restraint means 86. Handle means 85 are operably attached to a portion of first frame member 56 so as to facilitate carrying of the apparatus when it is in its collapsed orientation, as shown in FIG. 1. Furthermore, restraint means 86, which comprise straps, such as straps 87 and 88, are used to secure a child within the apparatus when the apparatus is attached to a table or other elevated member.

Figure 8:
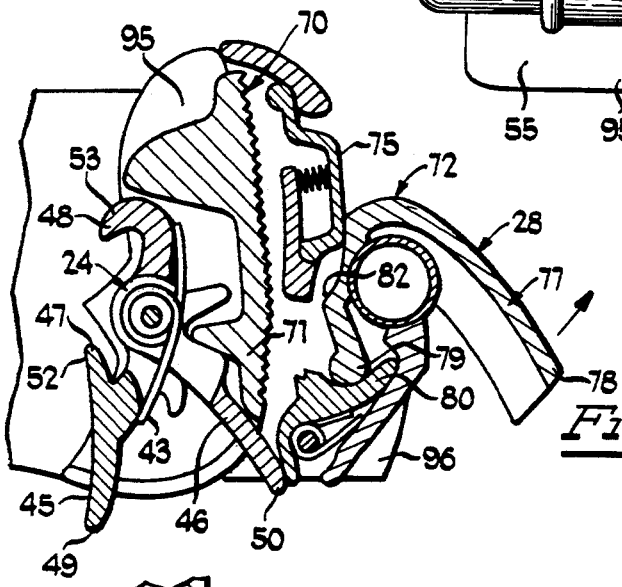
FIG. 8 of the drawings is an enlarged fragmentary elevated cross-sectional view of the securement means of the collapsible baby chair apparatus, showing, in particular, the locking means for securing the chair means in an open position, the pawl and rack of the ratchet mechanism, the position release handle, the gripping portion of the position release handle and the stop member which precludes inadvertent release of the pawl.
Figure 9:
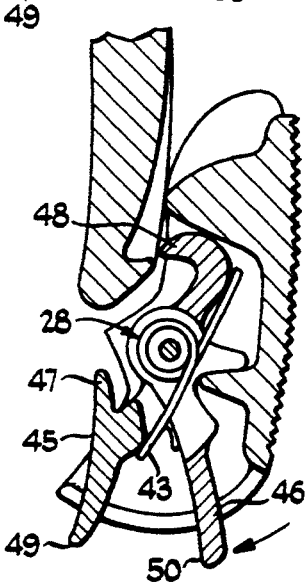
FIG. 9 of the drawings is an enlarged fragmentary elevated cross-sectional view of the locking means of the collapsible baby chair apparatus showing, in particular, the proximal lever ends of the biased levers and the distal hook ends of same.
Figure 10:
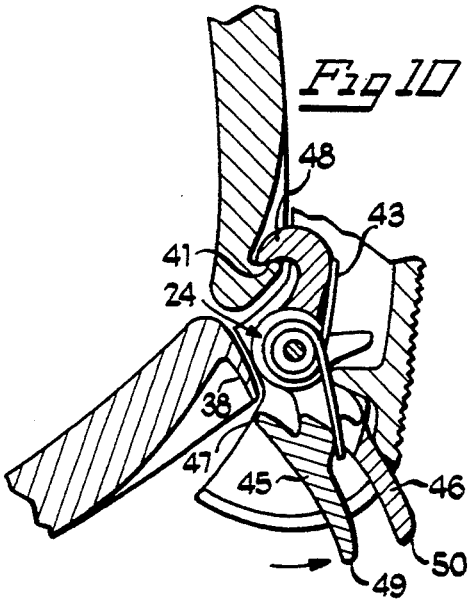
FIG. 10 of the drawings is an enlarged fragmentary elevated cross-sectional view of the locking means of the collapsible baby chair apparatus showing, in particular, the proximal lever ends of the biased levers and the distal hook ends of same in initial co-operation with the lip members of the back and seat portions.

Securement means 28 is shown in detail in FIGS. 3, 4 and 8 as comprising ratchet mechanism 70 and disengagement means 72. As shown in FIG. 8, ratchet mechanism 70 includes toothed rack 71 operably associated with back portion 95 of second frame member 55 (FIG. 1), and pawl 80 which is operably associated with back portion 96 of first frame member 56 (FIG. 1). Disengagement means 72 includes bias button 75 (release preclusion means) and position release handle 77. The position release handle comprises grasping portion 78, pawl release lever 79 and stop member 82 (FIG. 4). Pawl 80 will be disengaged from the teeth on rack 71 only upon first depressing biased button 75 and then simultaneously pulling grasping portion 78 of position release handle 77 outwardly, in the direction of the arrow shown in FIG. 8. Accordingly, such depression of biased button 75 will result in stop member 82 being allowed to move past the biased button, which, in turn, causes disengagement of pawl 80 from the teeth of rack 71.

Figure 5:
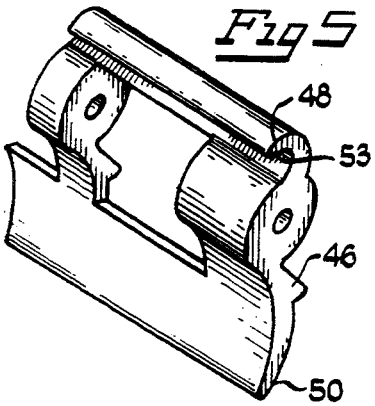
FIG. 5 of the drawings is an enlarged perspective view of the proximal lever end and distal hook end of a first portion of the locking means.
Figure 6:
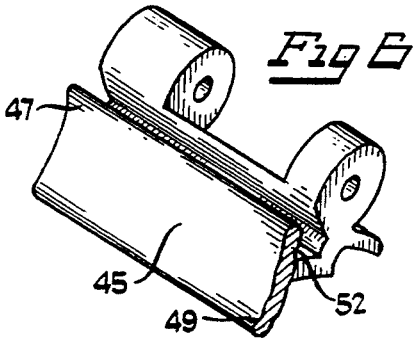
FIG. 6 of the drawings is an enlarged perspective view of a second portion of the locking means used to lockably engage the back portion of the chair means in an open position showing, in particular, the proximal lever end and the distal hook end of same.

Collapsible baby chair apparatus 20 is shown in FIG. 3 in its collapsed orientation, and prior to attachment to an elevated member, such as tabletop 90 as shown in FIG. 4. When in such a collapsed orientation, free ends, such as free end 57 of second frame member 55, and free ends, such as free end 62 of first frame member 56, will be positioned adjacent to each other, while seat portion 30 and back portion 32 of chair means 22 will have been folded into a closed position—thereby resulting in collapsible baby chair apparatus having a relatively thin transverse profile. As will be explained in detail, collapsing of apparatus 20 is intended to occur only after hooks 52 and 53 (FIGS. 5 and 6) of biased levers 45 and 46, respectively, have been manually released from lip members 38 and 41 (FIG. 3), respectively, of seat portion 30 and back portion 32, respectively, and after pawl 80 has been operably and positionably disengaged from rack 71, as shown in FIG. 8.

Actual attachment of collapsible baby chair apparatus 20 to an elevated member, such as table 90 as shown in FIG. 4, is accomplished by grasping seat portion 30 and back portion 32 of chair means 22 and pulling same apart, in the direction of the arrows shown in FIG. 3, until hook portion 52 of biased lever 45 operably engages lip member 38 of seat portion 30, and until hook portion 53 of biased lever 46 operably engages lip member 41 of back portion 32. Once the hooks of the biased levers have engaged the respective lip members, the seat and back portions will be securely maintained in their open position until the hooks are disengaged and the seat and back portions are folded back to their closed position.

Figure 7:
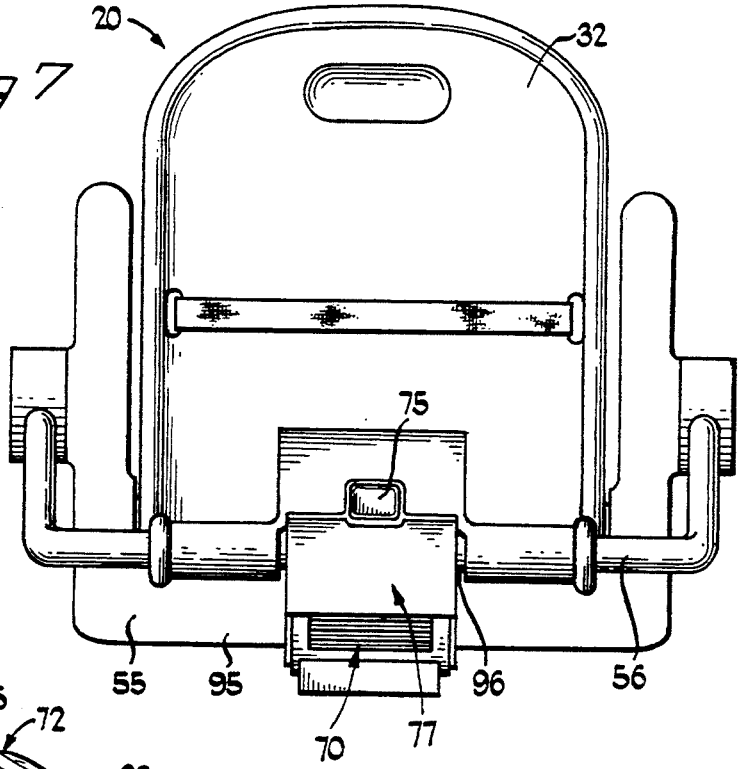
FIG. 7 of the drawings is a rear elevational view of the collapsible baby chair apparatus showing, in particular, the pivotal scissors-like attachment of the first, lower and second, upper frame members, the position-release handle and preclusion release means operably attached to the first frame member, and the rack of the ratchet mechanism operably attached to the second frame member.

After chair means 22 is in its fully open position, at least one of the first and second frame members 56 and 55, respectively, must be pivotally manipulated in a scissors-like manner so as to cause free ends 57 and 58 (FIG. 2) of second frame member 55 to spread apart from free ends 61 and 62 of first frame member 56. Such pivotal manipulation is accomplished by first depressing biased button 75, as shown in FIG. 8, and then, while maintaining biased button 75 in a depressed state, pulling gripping portion 78 of position release handle 77 in the direction of the arrow shown in FIG. 8. Indeed, failure to first depress biased button 75 will preclude operable movement of position release handle 77 as a result of interference between the biased button and stop member 82 of the position release means. However, when biased button 75 is first depressed, and gripping portion is then pulled, pawl 80 will be allowed to disengage from the teeth of rack 71 of ratchet mechanism 70. Accordingly while maintaining the gripping portion in its pulled out orientation, (the biased button can then be released), back region 96 (FIG. 7) of first frame member 56 can be pivoted upwardly in the direction of the arrow shown in FIG. 4, to, in turn, cause free ends 61 and 62 of first frame member 56 to spread apart from free ends 57 and 58 of second frame member 55. Accordingly, when the respective free ends are positioned far enough apart from each other, free ends 57 and 58 of second frame member 55 can be operably positioned over the top, overlying surface 90a, of table 90, and free ends 61 and 62 of first frame member 56 will be simultaneously operably positioned adjacent the bottom, underlying surface 90b of table 90. After the respective free ends are operably positioned adjacent the respective surfaces of the table, gripping portion 78 of position release handle 77 is released—thereby causing pawl 80 to operably engage with the teeth of rack 71, which, in turn, precludes further inadvertent spreading apart of the free ends of the frame members with respect to each other.

Tight securement of free ends 57 and 58 of second frame member 55 and free ends 61 and 62 of first frame member 56 to table 90 is accomplished by squeezing back region 95 (FIG. 7) and 96 of second frame member 55 and first frame member 56, respectively, and, in turn, pawl 80 and rack 71, in a substantially vertical direction. Such squeezing results in the respective free ends of the frame members closing toward each other until they are operably clamped to the tabletop and secured thereto by the ratchet mechanism.

Removal of apparatus 20 from the tabletop, and in turn, collapsing of same is simply achieved by reversing the procedure used with respect to attaching the apparatus to the tabletop. Accordingly, once apparatus 20 is removed, proximal lever ends 49 and 50 (FIGS. 9 and 10) of biased levers 45 and 46, respectively, are simultaneously, or individually depressed, so as to cause hooks 52 and 53, respectively, to disengage from the respective lip sections of the seat and back portions of the chair means. After such disengagement, the seat portion and back portion can be folded toward each other into a closed position. Once chair means 22 is fully closed, and after the free ends of the frame members have been completely closed adjacent each other, collapsible baby chair apparatus 20 will exhibit a relatively thin transverse profile, as shown in FIGS. 1 and 3, thereby making it convenient for carrying, as well as for storing and or shipping. Furthermore, when apparatus 20 is in such a collapsed orientation, frame member 55 is positioned to interfere with the periphery of seat portion 30 so as to help maintain the apparatus in its collapsed orientation.

The foregoing description and drawings merely explain and illustrate the invention and the invention is not limited thereto except insofar as the appended claims are so limited as those skilled in the art who have the disclosure before them will be able to make modifications and variations therein without departing from the scope of the invention.

What is claimed is:

1. A collapsible baby chair apparatus for attachment to an elevated member having a top and bottom surface, such as a tabletop or countertop, said apparatus being collapsible from a fully erected attached orientation to a collapsed orientation having a relatively thin transverse profile, said collapsible baby chair apparatus comprising:

chair means having a seat portion, including a front peripheral edge, and a back portion pivotally attached directly to said seat portion for providing a bottom and back support respectively for a child when the child is sitting in said collapsible baby chair apparatus, said chair means further including pivoting means between said seat and back portions for operably positioning both of said seat and back portions from a substantially closed position, when said collapsible baby chair apparatus is in said collapsed orientation, toward and into a substantially open position when said collapsible baby chair apparatus is in said fully erected attachment orientation;

locking means operably associated with at least one of said seat and back portions for releasably securing said seat and back portions in said substantially open position;

a pair of chair attachment means pivotally attached to each other for operably attaching said baby chair apparatus to said elevated member, said pair of attachment means including a first frame member and a second frame member, wherein at least one of said first and second frame members is operably attached to a portion of said chair means, said first frame member having at least two free ends positioned in substantially parallel and planar relationship with each other for underlying said bottom surface of said elevated member, said second frame member having at least two free ends positioned in substantially parallel and planar relationship with each other for overlying said top surface of said elevated member, said at least two free ends of said first frame member being in substantially adjacent relationship with respect to said at least two free ends of said second frame member respectively and being capable of being operably retractable from said at least two free ends of said second frame member toward attachment about said elevated member, said at least two free ends of said first and second frame member being capable of pivotal manipulation back toward one another respectively after said at least two free ends of said second frame member have been operably retracted from said at least two free ends of said first frame member to, in turn, enable operable clamped attachment about said elevated member, said pivotal manipulation of said at least two free ends of said first member toward said at least two free ends of said second member respectively further serving to reduce the transverse profile of said collapsible baby chair apparatus upon collapsing of same; and securement means operably attached to a portion of at least one of said first and second frame members for releasably maintaining said at least two free ends of said first and second frame members respectively clamped and relatively biased towards each other, after said first and second frame members, and, in turn, said collapsible baby chair apparatus, has been operably attached about said elevated member.

2. The collapsible baby chair apparatus according to claim 1 in which the invention further includes handle means operably attached to at least one of said first and second frame members for facilitating carrying of said collapsible baby chair apparatus when it is in its closed collapsed orientation.

3. The collapsible baby chair apparatus according to claim 1 in which each of said free ends of said first and second frame members extend beyond the front peripheral edge of said seat portion of said chair means when said chair means is in said substantially open position.

4. The collapsible baby chair apparatus according to claim 1 in which said collapsible baby chair apparatus further includes grasping means operably attached to said at least two free ends of both said first and second frame members for reducing the likelihood of said collapsible baby chair apparatus slipping, with respect to the elevated member to which it is attached.

5. The collapsible baby chair apparatus according to claim 4 wherein said grasping means is constructed from a material having a relatively high coefficient of friction.

6. The collapsible baby chair apparatus according to claim 1 wherein the invention further includes child restraint means operably attached to said chair means for securing a child within said chair means while in its fully erected open orientation.

7. The collapsible baby chair apparatus according to claim 6 wherein said child restraint means comprises one or more straps.

8. The collapsible baby chair apparatus according to claim 1 in which said securement means further includes disengagement means for releasing said at least two free ends of said first and second frame members from their said clamped and relatively biased positions relative to each other.

9. The collapsible baby chair apparatus according to claim 8 in which said securement means comprises at least one ratchet mechanism operably attached to said first and second frame members.

10. The collapsible baby chair apparatus according to claim 9 in which said at least one ratchet mechanism includes a rack having a plurality of teeth operably attached to one of said first and second frame members and a pawl being operably attached to the other of said first and second frame members.

11. The collapsible baby chair apparatus according to claim 10 wherein said disengagement means further includes release preclusion means for restricting inadvertent release of said securement means;

said release preclusion means comprising a biased button operably associated with said pawl, said pawl being precluded from release from said teeth of said rack until said biased button is independently held in a depressed position.

12. The collapsible baby chair apparatus according to claim 1 in which said locking means for releasably securing said seat and back portions in said substantially open position is spring biased so as to be self actuating upon manual manipulation of at least one of said seat and back portions of said chair means to said open position;

each of said seat and back portions being replaceable to their respective collapsed closed positions upon overcoming said bias of said locking means to disengage same.

13. The collapsible baby chair apparatus according to claim 12 in which said back portion of said chair means includes a bottom region having a back lip member and said seat portion includes a rear end region having a seat lip member;

said locking means including a biased lever having a distal end having at least one hook member and a proximal lever end, wherein said at least one hook member of said distal end is operably engageable with a respective one of said back and seat lip members of said back and seat portions respectively so as to maintain each of said seat and back portions releasably restrained in said open secured position, said hook members of said locking means being releasable from said respective back and seat lip members upon manual depression of said proximal lever ends, to, in turn, facilitate collapsibility of said back and seat portions respectively toward orientation into their said closed position.

14. The collapsible baby chair apparatus according to claim 13 in which said locking means for said seat portion, and said locking means for said back portion are interconnected with each other so as to pivot about a common pivot axis.

* * * * *